United States Patent [19]

Hooghiem et al.

[11] Patent Number: 5,018,605

[45] Date of Patent: May 28, 1991

[54] MAGNETIC RAIL BRAKE DEVICE

[75] Inventors: Jelle Hooghiem, Siegerswoude; Bart van der Sloot, Weidum; Sytse Epema, Gytsierk, all of Netherlands

[73] Assignee: Tebel Pneumatiek B.V., Leeuwarden, Netherlands

[21] Appl. No.: 406,462

[22] Filed: Sep. 13, 1989

[30] Foreign Application Priority Data

Sep. 15, 1988 [NL] Netherlands ..... 8802279
Sep. 15, 1988 [NL] Netherlands ..... 8802279

[51] Int. Cl.[5] ..... F16D 65/34
[52] U.S. Cl. ..... 188/165; 105/77
[58] Field of Search ..... 188/165; 105/77

[56] References Cited

U.S. PATENT DOCUMENTS

| | | | |
|---|---|---|---|
| 2,207,151 | 7/1940 | Hirshfeld | 188/165 |
| 2,966,236 | 12/1960 | Jones | 188/165 X |
| 3,625,317 | 12/1971 | Baermann | 188/165 |
| 4,482,034 | 11/1984 | Baermann | 188/165 |

FOREIGN PATENT DOCUMENTS

| | | | |
|---|---|---|---|
| 962895 | 5/1957 | Fed. Rep. of Germany | 188/165 |
| 799997 | 1/1981 | U.S.S.R. | 188/165 |
| 1463597 | 3/1989 | U.S.S.R. | 188/165 |
| 721748 | 1/1955 | United Kingdom | 188/165 |

*Primary Examiner*—George E. A. Halvosa
*Attorney, Agent, or Firm*—Merchant, Gould, Smith, Edell, Welter & Schmidt

[57] ABSTRACT

A magnetic rail brake device for rail vehicles, comprising one or more pairs of brake blocks adapted to be pulled, in operation, magnetically against the rail. The brake device is characterized by at least one permanent magnet movable up and down in a magnet housing. The magnet housing is arranged in such a manner that in rest position of the permanent magnet in the magnet housing, the magnetic field lines close through an upper portion of the magnet housing. In an operating position of the magnet in the magnet housing, the field lines can extend through pole pieces within brake block members of magnetizable material which can be brought into contact with the rail.

20 Claims, 3 Drawing Sheets

MAGNETIC RAIL BRAKE DEVICE

This invention relates to a magnetic rail brake device for rail vehicles, comprising one or more brake blocks adapted to be pulled, in operation, magnetically against the rail.

Rail brake devices of this type are known from practice. The known rail brake devices comprise electromagnets which, upon energization, pull the brake blocks against the rails, thereby decelerating the railway carriage in question.

A drawback of the known rail brake devices is that the electromagnets require relatively vulnerable electric windings and supply lines. Another drawback is that, in the event of power breakdown, there is no possibility of pressing the brake blocks, e.g. through manual operation, with sufficient force against the rails.

It is an object of the present invention to provide a new type of rail brake device which lacks the above drawbacks. In general, it is an object of the present invention to provide a relatively simple, robust and effective rail brake device.

To that effect, according to the present invention, a rail brake device of the above described type is characterized by at least one permanent magnet movable up and down in a magnet housing which is so arranged that, in a rest position of the permanent magnet in its housing, the magnetic field lines close through an upper portion of the magnet housing, while in the operating position of the magnet in the magnet housing, the field lines can extend through pole pieces within brake block members of magnetizable material, which brake block members can be brought into contact with the rail.

Some embodiments of the present invention will now be described, by way of example, with reference to the accompanying drawings.

Figure 1:
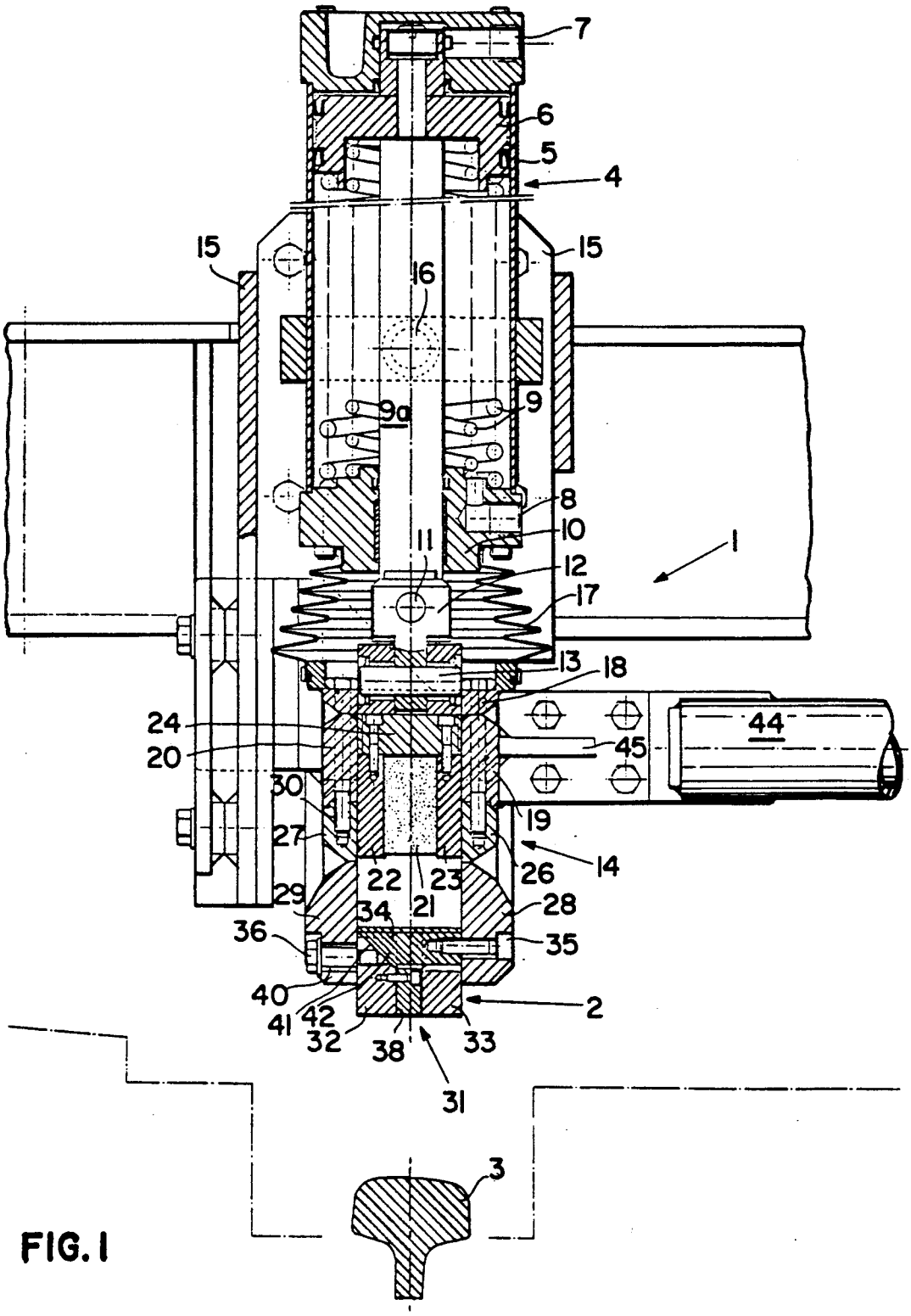
FIG. 1 is a diagrammatic, cross-sectional front view of an embodiment of a rail brake device according to the invention.

FIG. 1 is a diagrammatic, cross-sectional front view of an embodiment of a rail brake device according to the present invention. The rail brake device 1 shown comprises one or more brake blocks 2 adapted to be moved, in operation, in a substantially vertical direction from and towards a rail 3 by means of suitable operating members.

In the embodiment shown, the operating members include two (see FIG. 2) hydraulic or pneumatic cylinders 4 mounted above brake block 2 and connected to brake block 2. The cylinder shown is a double-acting cylinder having a cylinder block 5, a piston 6 and, on either side of the piston, a port 7 and a port 8. The piston is kept in the rest position through one or more springs 9, in which position brake block 2 is spaced above rail 3.

The piston 6 is connected to a piston rod 9*a* extending downwardly through a bore in a lower end wall 10 of the cylinder.

The piston rod 9*a* is connected with the end extending freely through the end wall 10 to a connecting piece 12 by means of a first pivot pin 11. Connecting piece 12, in its turn, is connected in a manner to be described to a permanent magnet disposed within a magnet housing 14 by means of a second pivot pin 13 extending transversely to the first pivot pin.

The cylinder 4 is connected to a portion of the carriage frame 15, not to be further defined. The connection between the cylinder and portion 15 is effected in this example by means of a pin 16 (see also FIG. 2), providing some freedom of rotation to the cylinder.

The connecting piece 12, due to the two mutually transverse pivot pins 11 and 13, forms a universal joint imparting some freedom of movement to the magnet with the magnet housing 14 and the brake block 2 connected thereto, so that the brake block can follow the rail 3 under any practical circumstances.

The cylinder 4 and the magnet housing 14 are further connected by a bellows-shaped dust hood 17, protecting the universal joint 11,12,13 against dust and dirt.

Figure 2:
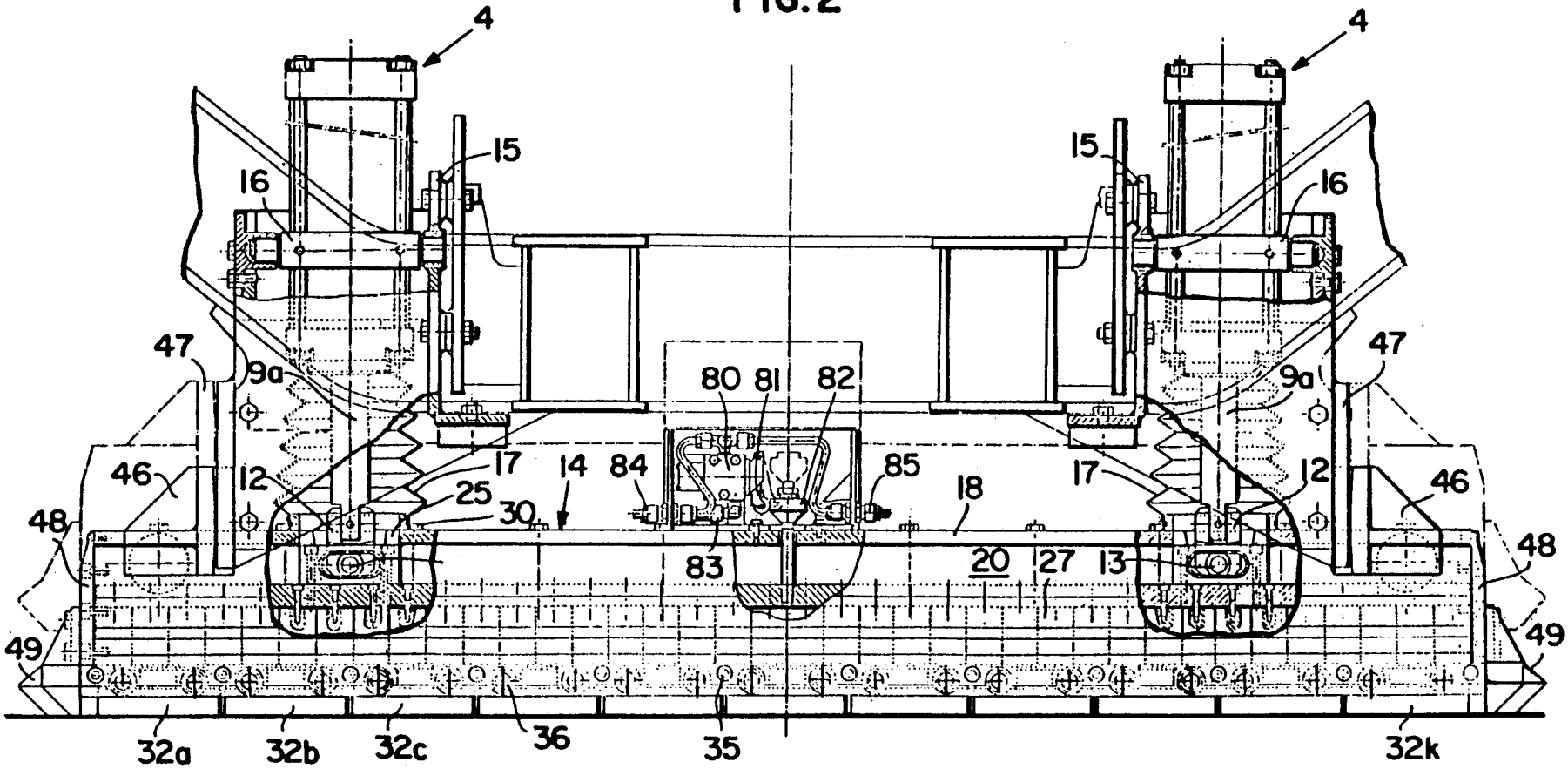
FIG. 2 is a diagrammatic side view, partly in cross section, of the device shown in FIG. 1.

The magnet housing 14, in cross section, has a substantially inverted U-shaped upper portion with a top plate 18 and two side plates 19,20. Top plate 18, at the location of connecting piece 12, is provided with an opening 25, as shown in FIG. 2.

The top plate 18 and side plates 19,20 are made from magnetizable material, e.g. from steel thirty seven, and are interconnected suitably, e.g. by welding, as shown in FIG. 1.

Provided between the side plates is a permanent magnet 21 wedged, according to the so-called sandwich method, between two plates 22,23 of magnetizable material, such as steel 37, serving as pole pieces.

The assembly of plates 22,23 and the permanent magnet 21 likewise plate-shaped transversely to the plane of drawing of FIG. 1, just fits between side plates 19,20 of the magnet housing, but is adapted for up and down sliding movement.

The pole faces of the permanent plate magnet lie against the plates 22,23 serving as pole pieces. Such a sandwich configuration allows to obtain a substantially greater magnetic force than when a plate magnet without pole plates is employed.

The pole plates 22,23 are interconnected by means of a connecting plate 24 of non-magnetizable material disposed between the top of the magnet and the housing. Plate 24 may be made e.g. from stainless steel or another suitable material and, in this example, is connected to the pole plates through screwed bolts.

As a result of connecting plate 24 of non-magnetizable material, the field lines of the magnetic field, in the rest position of the magnet shown, close through the inverted-U-shaped upper portion 18,19,20 of the magnet housing, thereby firmly maintaining the permanent magnet in the rest position.

The edges of side plates 19,20 of the magnet housing remote from top plate 18 link up with plates 26,27 of non-magnetizable material, e.g. stainless steel. Magnet 21, in the rest position, does not extend beyond the lower edge of the non-magnetizable plates 26,27 facing away from side plates 19,20, so that, in the rest position, the magnet is so to say magnetically insulated from the pole pieces 28,29 adjoining the non-magnetizable plates 26,27. The pole pieces are made from magnetizable material, e.g. steel thirty seven.

The side plates 19,20, the magnetically insulating plates 26,27 and the pole pieces 28,29 together form a housing wherein magnet 21 can move up and down together with pole plates 22,23.

One or more pairs of brake blocks 32,33 are mounted between pole pieces 28,29.

Furthermore, the pole pieces are interconnected through a connecting piece 34 of non-magnetizable material. The connecting piece also serves as a seal for the magnet housing and as a reinforcing member. The connecting piece may be made e.g. from stainless steel and is attached to the pole pieces through bolts 35.

The brake blocks are mounted underneath the connecting piece between the pole pieces. Each brake block in this example is plate-shaped and attached to the pole pieces with bolts 36.

Provided between brake blocks 32,33 is an air gap 31 filled up preferably, as shown, with a magnetically insulating filler 38, e.g. wood, synthetic plastics material, aluminum, stainless steel or the like.

Filler 38 prevents deposition of dirt and of metal dust from the brake blocks and the rail in the air gap between the brake blocks.

The brake blocks are attached with some freedom of movement to the pole pieces, so that the position of the brake blocks can be adjusted to the rail during braking. To that end, the fixing bolts 36 extend through ample bores 40 into the pole pieces.

Furthermore, in this example, the brake blocks and the connecting piece 34 have complementarily profiled facing faces 41, which leave some interspace 42.

A brake shoe of a single rail brake device consists preferably of a plurality of sections located lengthwise of the device, one behind the other, as shown at 32*a*–32*k* in FIG. 2.

A practical rail brake device may have a length of e.g. approximately 1½ meters, and magnet 21 has a corresponding length.

FIG. 1 also shows a kind of track rod 44, which is connected at 45 to the brake device shown and which is coupled with the other end to a brake device coacting with the other rail.

The operation of the rail brake device is as follows. In FIG. 1, the magnet 21 is in the rest position, i.e. the magnet is present between side plates 19,20 of the magnet housing. The magnet housing itself is likewise in the rest position, i.e. in a relatively high position, wherein the brake blocks are spaced freely above the rails.

Upon energization of cylinders 4 through port 7, piston rod 9*a* moves downwards and magnet 21 is likewise moved downwards. The magnet then takes along the magnet housing.

As soon as brake blocks 32,33 touch the rails, upon continued energization of cylinder 4, the magnet is pulled loose from side plates 19,20 and from top plate 18 against the magnetic force, and the magnet moves through the magnet housing in the direction of the pole pieces. As soon as pole plates 22,23 of magnet 21 arrive within the range of the pole pieces, the field lines of the magnetic field of the permanent magnet can close through the first pole piece, a brake block, the head of the rail, the second brake block and the second pole piece. The magnet pulls the intermediate brake blocks with maximum force against the head of the rail when the magnet lies against the connecting piece 34, so that the vehicle running on the rail is decelerated.

The deceleration is terminated by energizing cylinder 4 in opposite sense through port 8.

The magnet is then pulled again towards the rest position and, partly through spring 9, maintains itself in that position as a result of the field lines closing through the side plates and the top plate of the magnet housing. Subsequently, the magnet housing comes clear of the rail and is pulled upwards into the position shown in FIG. 1.

FIG. 2 shows at 46 a guide member attached to the magnet housing adapted for up and down movement and which coacts with a corresponding part 47 of the carriage frame during the up and down movement of the magnet housing.

Furthermore, end plates 48 are mounted at the front and back of the magnet housing, as shown in FIG. 2, which end plates are made from non-magnetizable material, such as stainless steel. Provided on end plates 48 are end parts 49, serving for guiding the brake shoe along any obstacles along the rails.

FIG. 2 also shows a switch valve 80 with a switch lever 81, which can be operated by a cam member 82 coupled to the magnet. The valve, depending on the position of lever 81, connects a supply line 83 for pressure medium to lines 84,85 conducting to the ports 7 of cylinders 4, or disconnects the connection.

In the position shown in solid lines in FIG. 2, the magnet is in the braking position and the valve forms a lock. As the magnet (or magnets) pulls itself against the rail through the pole pieces and the brake blocks, no energization of the cylinders is necessary in that position. By relieving in the manner shown, cylinders 4 in that position, a longer life of the cylinders is obtained.

Figure 3:
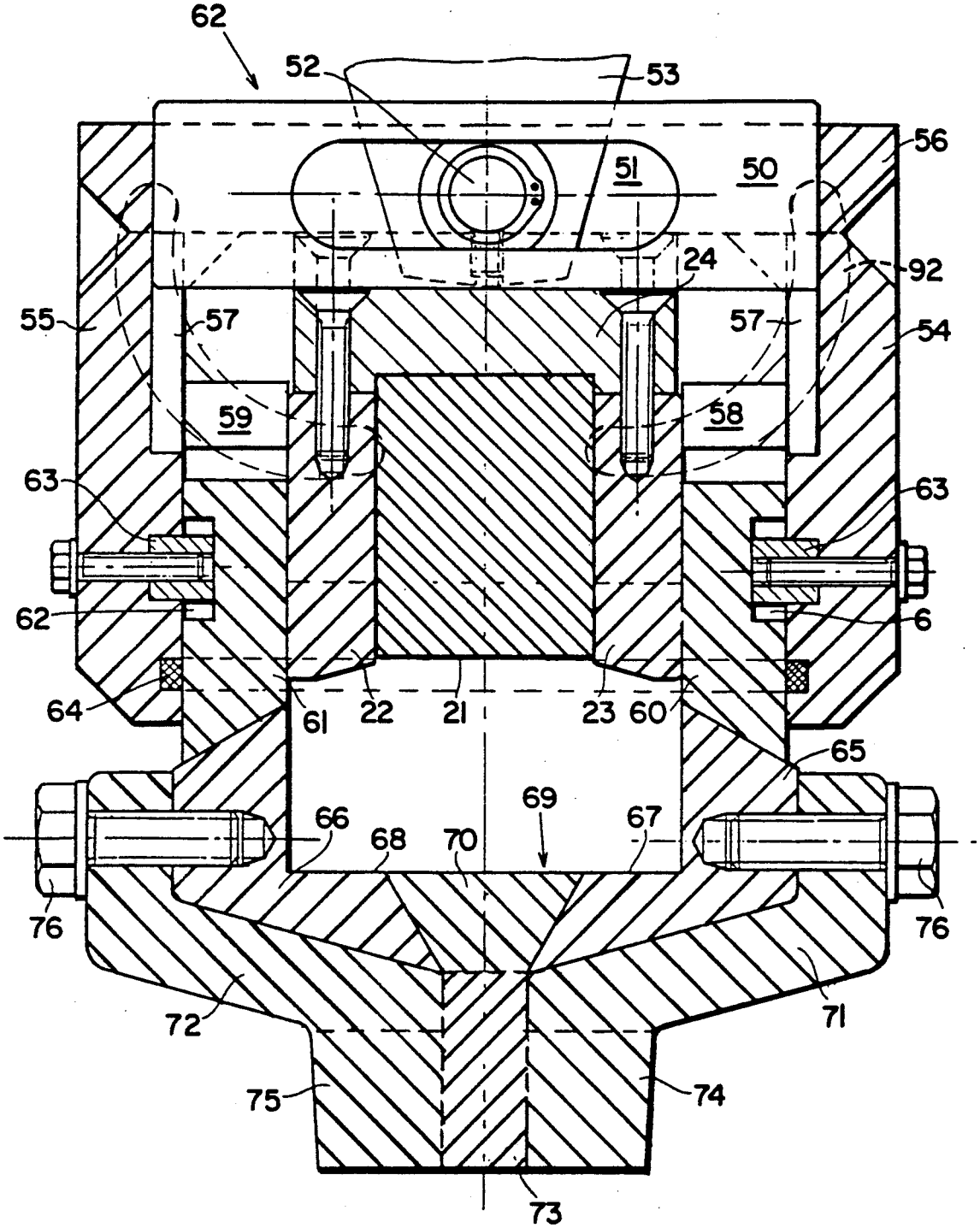
FIG. 3 is a diagrammatic, cross-sectional front view of another embodiment of a device according to the invention.

FIG. 3 shows another embodiment of a device according to the invention in a similar view as shown in FIG. 2.

FIG. 3 again shows a permanent magnet 21 placed between pole plates 22,23. The pole plates are interconnected at the tops by a fixing plate 24 of non-magnetizable material, e.g. aluminum or stainless steel or the like.

Plate 24 is connected by means of a cross bar 50 and a pivot pin 52 extending through a slotted hole 51 into the cross bar, to the lower end of an operating member, such as a hydraulic or pneumatic cylinder.

The cross bar 50 is adapted for up and down movement between side plates 54,55 of an inverted-U-shaped magnet housing of magnetizable material, such as steel thirty seven. At the location of the cross bar, top plate 56 of the magnet housing has an opening. Vertical slots 57 are provided in the side plates for guiding cross bar 50.

The magnet is drawn in the rest position, wherein the tops of magnet 21 and of pole plates 22,23 lie at the level of two flanges 58,59 functioning as pole pieces and extending inwardly from the side plates of the magnet housing.

Lying at some distance underneath flanges 58,59 against the facing surfaces of side plates 54,55 are plates 60,61 of magnetically insulating material, such as aluminum. In the position shown, the aluminum plates 60,61 abut partly against the pole plates of the magnet. The magnet again has a pole face at the left and at the right. The field lines of the magnet can only close through flanges 58,59, side plates 54,55 and top plate 56, as diagrammatically shown at 92.

The plates 60,61 of magnetically insulating material are attached with some freedom of movement against the side plates 54,55. In the example shown, use is made to that effect of a groove 62 provided in each of the plates 60,61, into which groove extend one or more projections 63 attached to side plates 54,55, said projections being narrower than the width of the groove. Furthermore, use is also made of a sealing member 64 set in the side plates.

The plates 60,61 of magnetically insulating material extend to beyond the free lower edge of side plates 54,55 and link up with pole pieces 65,66 of magnetizable material, such as steel 37. The pole pieces, spaced apart from plates 60,61, have flanges 67,68 oriented towards one another, leaving a gap 69 having the shape of an inverted trapezium in this example, said gap 69 being filled in this example with a magnetically insulating connecting piece or filler 70.

The magnetically insulating plates 60,61, the pole pieces 65,66 and the filler 70 together form a U-shaped housing placed with the open end in the inverted-U-shaped magnet housing and which can guide magnet 21 with pole plates 22,23 upon an upward and downward movement.

At the exterior, fitting brake block parts 71,72 are attached against the pole pieces 65,66, leaving an air gap filled up again in this example with a magnetically insulating filler 73. Brake block parts 71,72 are made from magnetizable material and preferably have a downwardly extending flange 74,75 on either side of the gap. The brake block parts in this example are attached to the pole pieces through screwed bolts 76.

When the magnet housing is contacted with a rail head by an operating member and the magnet is shifted between plates 60,61 to against flanges 67,68, the field lines can again be closed through the pole pieces, the brake block parts and the head of the rail, so that the brake block parts are pulled with force against the rail.

It is observed that, after reading the above, various modifications will readily occur to one skilled in the art.

For instance, the magnet may be divided lengthwise into sections.

If desired, a friction-increasing material, such as brake lining material, may be employed for the material of filler 38, and 73, respectively.

Furthermore, hand-operated means for manually moving the permanent magnet up and down may be provided.

These and similar modifications are deemed to fall within the scope of the present invention.

We claim:

1. A magnetic rail brake device for rail vehicles, comprising:

(a) at least one pair of brake blocks adapted to be engaged magnetically against the rail;

(b) at least one permanent magnet, the permanent magnet generating magnetic field lines;

(c) a magnet housing, the magnet housing being formed so as to have a substantially inverted u-shaped upper portion created by a top plate and an adjoining first side plate and an adjoining second side plate;

(d) a double acting cylinder, further comprising:

(i) a cylinder block;

(ii) a piston, the piston traveling within the cylinder block;

(iii) at least one port, the port permitting adjustment of piston position within the cylinder by a pressure medium;

(iv) a piston rod;

(v) at least one spring, the spring permitting biasing of the piston position within the cylinder block;

(e) a universal joint, the universal joint being operatively interconnected between the piston rod and the magnet housing, such that the magnetic field lines close through an upper portion of the magnet housing when the permanent magnet is in a first position, and in a second position of the permanent magnet in the magnet housing the field lines can extend through pole pieces within brake block members of magnetizable material adapted to be brought into contact with the rail the second position being reached by unidirectional movement of the permanent magnet and the pole pieces; and (f) a dust hood, the dust hood being formed as a bellows surrounding the universal joint, thereby protecting the universal joint against dust and dirt.

2. A magnetic single rail brake device comprising:

(a) at least one pressure actuated cylinder, the cylinder being pivotably affixed to a carriage frame of a vehicle to be braked;

(b) at least one piston rod, each piston rod being slidably mounted within each cylinder;

(c) at least one universal joint, each universal joint being operatively connected to an end of the piston rod external to the cylinder;

(d) at least one permanent magnet;

(e) at least one magnet housing, the magnet housing having a substantially inverted u-shaped upper portion formed with a top plate and two side plates, the top plate having an opening, the opening permitting the universal joint to enter the magnet housing, the universal joint being mechanically linked to the permanent magnet;

(f) at least one brake shoe, each brake show being formed as a plurality of sections located sequentially along a line substantially perpendicular to the piston rod, the brake shoe being mechanically linked to the permanent magnet such that the brake shoe tends to engage the rail when the piston rod moves in a downward direction, an upper portion of the magnet housing being connected to pole pieces within the brake shoe through structural members of non-magnetizable material;

(g) at least one guide member, the guide member being located at an end region of the brake device, the guide member being attached to the magnet housing, the guide member moving in a substantially vertical direction and engaging a portion of the carriage frame during said vertical movement;

(h) at least one end plate, the end plate being mounted at a face of the magnet housing, the end plates being formed of a non-magnetizable material, the end plate including an end part, the end part tending to guide the brake shoe over any obstacle encountered along the rail; and (i) a pressurization system, the pressurization system comprising:

(i) a switch valve;

(ii) a switch lever, the switch lever operating the switch valve;

(iii) a cam member, the cam member being mechanically coupled to the permanent magnet, the cam member operating the switch lever;

(iv) at least one supply line, the supply line being mechanically coupled to and in fluid communication with each pressure actuated cylinder;

(v) a pressure medium, the pressure medium being supplied to the cylinders via the supply line in response to actuation by the cam member, said pressure actuation being relieved when the permanent magnet pulls itself toward the rail, thereby reducing cylinder wear.

3. A magnetic rail brake device as claimed in claim 1, characterized in that the permanent magnet consists of at least one transversely polarized plate of permanently magnetic material covered on both sides with pole plates.

4. A magnetic rail brake device as claimed in claim 3, characterized in that the permanent magnet is insulated from the top plate of the magnet housing by a plate of non-magnetizable material but in the rest position is coupled magnetically with the side plates of the magnet housing.

5. A magnetic rail brake device as claimed in claim 4, characterized in that the side plates of the magnet housing adjoin plates of non-magnetizable material which in the rest position of the permanent magnet extend in a direction away from the top plate of the magnet housing to beyond the permanent magnet, and that the plates of non-magnetizable material adjoin pole pieces of magnetizable material provided with brake block members.

6. A magnetic rail brake device as claimed in claim 5, characterized in that the plates of non-magnetizable material are attached to the inside of the magnet housing against the side plates thereof and extend to beyond the lower edge of the side plates.

7. A magnetic rail brake device as claimed in claim 6, characterized in that the plates of non-magnetizable material are mounted with some sliding freedom along the side plates.

8. A magnetic rail brake device as claimed in claim 6, characterized in that the plates of non-magnetizable material are provided at the edges extending beyond the side plates with L-shaped pole pieces of magnetizable material having legs extending towards one another to leave an interspace filled by a connecting piece of non-magnetizable material.

9. A magnetic rail brake device as claimed in claim 8, characterized in that at least one brake block member is attached against each pole piece and that opposed brake block members leave an interspace underneath the pole pieces.

10. A magnetic rail brake device as claimed in claim 9, characterized in that the interspace is filled up with a filler of non-magnetizable material.

11. A magnetic rail brake device as claimed in claim 5, characterized in that the pole pieces are coextensive with the plates of non-magnetizable material and are interconnected so as to seal and reinforce the magnet housing by a connecting piece of non-magnetizable material.

12. A magnetic rail brake device as claimed in claim 11, characterized in that each brake block member is coupled with the connecting piece in shape-conforming but slightly interspaced relationship.

13. A magnetic rail brake device as claimed in claim 11, characterized in that at least one brake block member of magnetizable material is provided on each pole piece underneath the connecting piece.

14. A magnetic rail brake device as claimed in claim 13, characterized in that each brake block member is mounted with some sliding freedom along the associated pole piece.

15. A magnetic rail brake device as claimed in claim 13, characterized in that the at least one brake block member pertaining to each pole piece is separated by a gap from the brake block member pertaining to the opposite pole piece.

16. A magnetic rail brake device as claimed in claim 15, characterized in that the gap is filled up with a filler of non-magnetizable material.

17. A magnetic rail brake device as claimed in claim 1, characterized in that the piston rod is connected with some freedom of rotation, through at least one pivot pin to a plate of non-magnetizable material mounted on the permanent magnet.

18. A magnetic rail brake device as claimed in claim 1, characterized in that the magnet housing is an elongate housing and that the brake block members are composed of sections located lengthwise one behind another.

19. A magnetic rail brake device as claimed in claim 1, characterized in that the permanent magnet is composed of sections, adjoining each other in end-to-end fashion.

20. A magnetic rail brake device as claimed in claim 1, characterized by switching means which coact with a cam member coupled with the magnet, said switching means, in the operating position of the permanent magnet, relieving the double-acting cylinder(s).

* * * * *